United States Patent [19]

Watanabe et al.

[11] Patent Number: 5,036,247

[45] Date of Patent: Jul. 30, 1991

[54] DOT MATRIX FLUORESCENT DISPLAY DEVICE

[75] Inventors: Tomomi Watanabe; Hiroyuki Komata, both of Saitama, Japan

[73] Assignee: Pioneer Electronic Corporation, Tokyo, Japan

[21] Appl. No.: 492,393

[22] Filed: Mar. 7, 1990

Related U.S. Application Data

[63] Continuation of Ser. No. 193,182, May 11, 1988, abandoned, which is a continuation of Ser. No. 905,429, Sep. 10, 1986, abandoned.

[30] Foreign Application Priority Data

Sep. 10, 1985 [JP] Japan ..... 60-138609

[51] Int. Cl.[5] ..... H01J 31/15

[52] U.S. Cl. ..... 313/496; 313/491

[58] Field of Search ..... 313/491, 492, 494–497, 313/514, 517–519

[56] References Cited

U.S. PATENT DOCUMENTS

| | | | |
|---|---|---|---|
| 4,135,112 | 1/1979 | Fischer et al. | 313/472 |
| 4,140,941 | 2/1979 | Uemura | 313/495 |
| 4,149,147 | 4/1979 | Kishino | 340/760 |
| 4,193,014 | 3/1980 | Nixon | 313/495 |
| 4,223,244 | 9/1980 | Kishino et al. | 313/497 |
| 4,303,917 | 12/1981 | Kishno et al. | 340/772 |
| 4,368,404 | 1/1983 | Daisyaku | 313/497 |
| 4,401,982 | 8/1983 | Miyazaki et al. | 313/497 X |
| 4,412,213 | 10/1983 | Nishino et al. | 340/772 X |
| 4,455,774 | 6/1984 | Watanabe | 313/496 |
| 4,468,589 | 8/1984 | Hikida et al. | 313/496 |
| 4,486,749 | 12/1984 | Kishino et al. | 340/760 |
| 4,540,983 | 9/1985 | Morimoto et al. | 313/497 X |
| 4,551,737 | 11/1985 | Inokuchi | 313/496 |
| 4,563,613 | 1/1986 | Genovese et al. | 313/495 |
| 4,588,921 | 5/1986 | Tischer | 313/496 |
| 4,618,801 | 10/1986 | Kakino | 313/495 |
| 4,633,134 | 12/1986 | Kishino et al. | 313/497 |
| 4,692,663 | 9/1987 | Kobayashi et al. | 313/495 |
| 4,733,139 | 3/1988 | Morimoto | 313/497 X |

FOREIGN PATENT DOCUMENTS

| | | | |
|---|---|---|---|
| 0064353 | 5/1980 | Japan | 313/495 |
| 0096449 | 6/1982 | Japan | 313/495 |
| 0131738 | 7/1985 | Japan | 313/495 |

*Primary Examiner*—James J. Groody
*Assistant Examiner*—Mark R. Powell
*Attorney, Agent, or Firm*—Sughrue, Mion, Zinn, Macpeak & Seas

[57] ABSTRACT

A dot matrix, fluorescent display tube having a filament, a grid and array of anodes on which light emitters are placed. Two or more light emitters are placed on at least one of the anodes.

7 Claims, 3 Drawing Sheets

DOT MATRIX FLUORESCENT DISPLAY DEVICE

This is a continuation of application Ser. No. 07/193,182 filed May 11, 1988 which is a continuation of application Ser. No. 905,429 filed Sept. 10, 1986, both now abandoned.

BACKGROUND OF THE INVENTION

1. Field of the Invention

The present invention relates to a dot-matrix fluorescent display device. More particularly, it relates to a dot-matrix fluorescent display device employing a fluorescent display tube.

2. Background Art

A dot-matrix fluorescent display device employing a fluorescent display tube is often used for a video or audio device to indicate by a selected lit numeral or character a received frequency, a selected mode or the like. The general operation of the fluorescent display tube is hereafter described with reference to FIG. 1. In the tube, a filament 1 is heated by electric power from an AC power supply 2 to thereby emit thermoelectrons. The electrons are accelerated and diffused by a grid $g_i$ to which a grid drive voltage $VG_i$ is applied. After passing through the grid $g_i$, the electrons collide against a plurality of anodes $A_{ij}$ to which a separate anode drive voltage $VA_{ij}$ is applied to each of the plurality of anodes $A_{11}$–$A_{mn}$. As a result, a light emitter (not shown in the drawing) provided on the surface of each anode $A_{ij}$ emits light. If the fluorescent display tube has 5×7 (35) image elements, 5×7 (35) anodes $A_{ij}$ are disposed in a matrix to form an anode group $AG_i$, as shown in FIG. 2. Anode lead wires $\mathbf{1}_{11}$ to $\mathbf{1}_{75}$ are connected to the anodes $A_{11}$–$A_{75}$. The grid $g_i$ is provided in opposition to every matrix-disposed anode group $AG_i$, as shown in FIG. 4. Multiple anode groups $AG_i$ provide multiple displayed characters.

FIG. 3 shows an enlarged sectional view of the anode $A_{ij}$ included in the fluorescent display tube. The light emitter 3 is provided on the surface of the anode $A_{ij}$. The anode lead wire $\mathbf{1}_{ij}$ is connected to the anode $A_{ij}$.

FIG. 4 shows a schematic view of a conventional dot-matrix fluorescent display device employing such a fluorescent display tube as described above. In the device, each of a number n of anode groups $AG_1$–$AG_n$ corresponds to one character. The n anode groups $AG_1$–$AG_n$ correspond to a line of characters. In each anode group $AG_i$, 5×7 (35) anodes $A_{ij}$ are disposed in a matrix, as shown in FIG. 2. The anode lead wire $\mathbf{1}_{ij}$ for the anode $A_{ij}$ of the anode group $AG_i$ is connected to the anode lead wire $\mathbf{1}_{ij}$ for the anode $A_{ij}$ of the adjacent anode group $AG_{i+1}$. An anode drive voltage $VA_{ij}$ is applied through the anode lead wire $\mathbf{1}_{ij}$ to the anode $A_{ij}$ with its attached light emitter 3, to cause it to emit light. It is probable that the anode drive voltage $VA_{ij}$ is applied to a plurality of similarly situated anodes $A_{ij}$ simultaneously. Grids $g_1$–$g_n$ are independently provided for the anode groups $AG_1$–$AG_n$. Grid drive voltages $VG_1$–$VG_n$ are sequentially applied to the grids $g_1$–$g_n$ in a time division multiplex manner.

FIG. 5 shows a timing diagram of examples of the grid drive voltages $VG_1$–$VG_n$ and the anode drive voltage $VA_{ij}$ for the dot-matrix fluorescent display device shown in FIG. 4. Since the grid drive voltages $VG_1$–$VG_n$ are applied to the grids $g_1$–$g_n$ in time division multiplex and the anode drive voltage $VA_{ij}$ is applied to the anodes $A_{ij}$ of the anode groups $AG_1$–$AG_n$, the light emitter 3 emits light only if it is located on the anode $A_{ij}$ of the anode group $AG_i$ for which the grid drive voltage $VG_1$ and the anode drive voltage $VA_{ij}$ are simultaneously applied. For the same reason, the light emitter 3 provided on the anode $A_{ij}$ of the anode group $AG_n$ later emits light as well for a different combination of grid drive voltage $VG_n$ and anode drive voltage $VA_{ij}$.

The above-mentioned conventional dot-matrix fluorescent display device needs a number of anode lead wires $\mathbf{1}_{ij}$, which number corresponds to that of the number of anodes $A_{ij}$ which constitute each of the anode groups $AG_i$. If each anode group $AG_i$ is composed of 5×7 (35) anodes $A_{ij}$ in a matrix group, 35 anode lead wires $\mathbf{1}_{ij}$ are needed. However, in reality, anode drive voltage is simultaneously applied to several anodes $A_{ij}$ through the corresponding anode lead wires $\mathbf{1}_{ij}$. When only a predetermined image such as "PLAY" and "FF" is to be indicated by the dot-matrix fluorescent display device for a video or audio device, anode drive voltages are always simultaneously applied to a plurality of anodes $A_{ij}$ in predetermined anode groups $AG_i$ through the corresponding anode lead wires $\mathbf{1}_{ij}$. For that reason, the number of all the anode lead wires $\mathbf{1}_{ij}$ of the device is so large that the device is very complicated.

SUMMARY OF THE INVENTION

Accordingly, an object of the present invention is to provide a dot-matrix fluorescent display device including a fluorescent display tube in which image elements are lit by using a number of anodes which is less than the number of image elements.

In the dot-matrix fluorescent display device of the invention, a plurality of light emitters are provided on at least one of the plural anodes so that the plurality of light emitters simultaneously emit light when drive voltages are applied to the anode and a grid, respectively. For that reason, the dot-matrix fluorescent display device can be made of fewer anodes than the image elements.

When the dot-matrix fluorescent display device is used for a video or audio device in which a displayed image is limited, dot-matrix displaying with a high quality image can be easily performed.

DETAILED DESCRIPTION OF THE PREFERRED EMBODIMENTS

An embodiment of the present invention is hereafter described with reference to the drawings.

Figure 1:
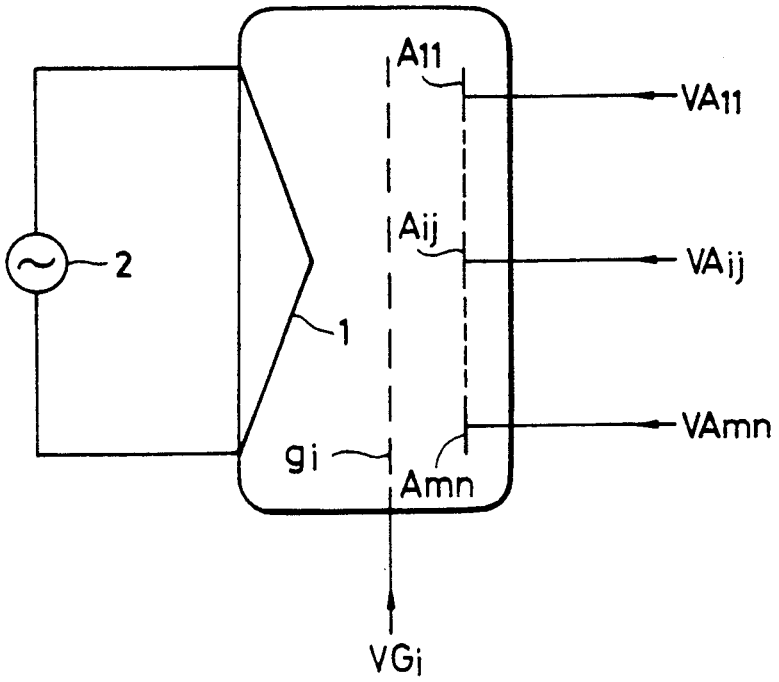
FIG. 1 PRIOR ART
FIG. 1 shows a schematic view of a conventional fluorescent display tube.
Figure 3:
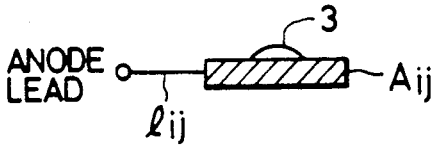
FIG. 3 PRIOR ART
FIG. 3 shows an enlarged sectional view of a conventional anode.
Figure 4:
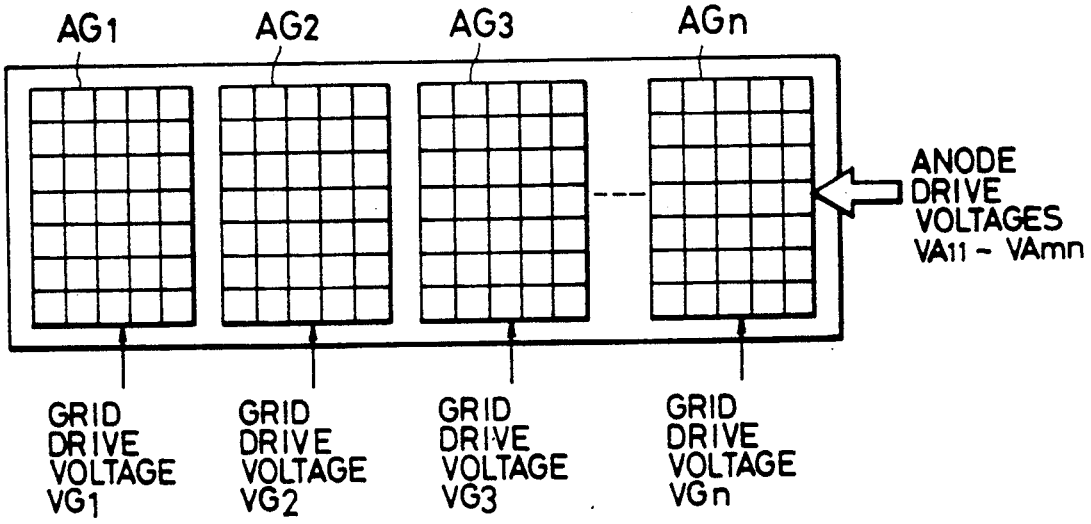
FIG. 4 PRIOR ART
FIG. 4 shows a schematic view of a conventional dot-matrix fluorescent display tube.
Figure 2:
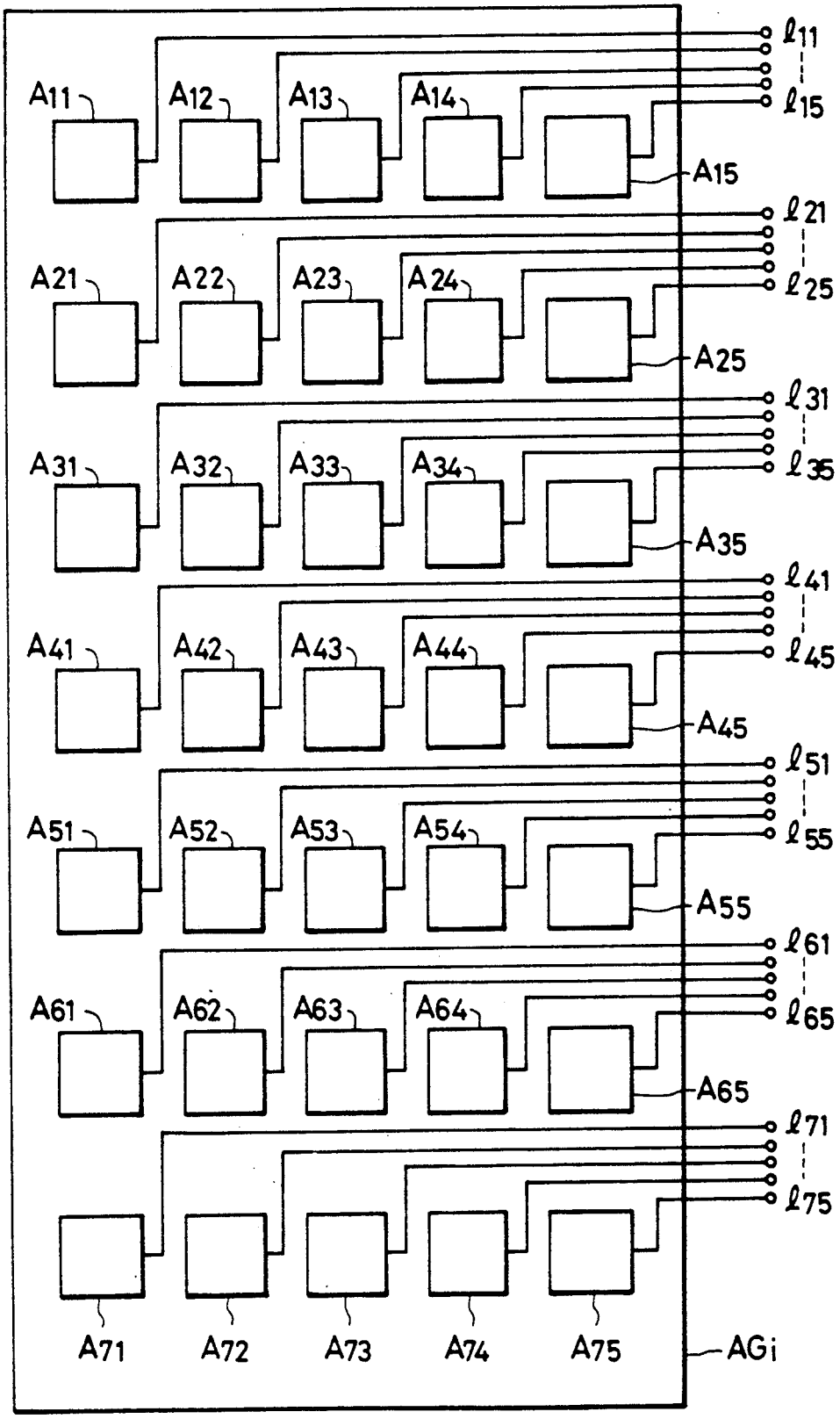
FIG. 2 PRIOR ART
FIG. 2 shows the matrix disposition of the anode group of a conventional dot-matrix fluorescent display device.
Figure 5:
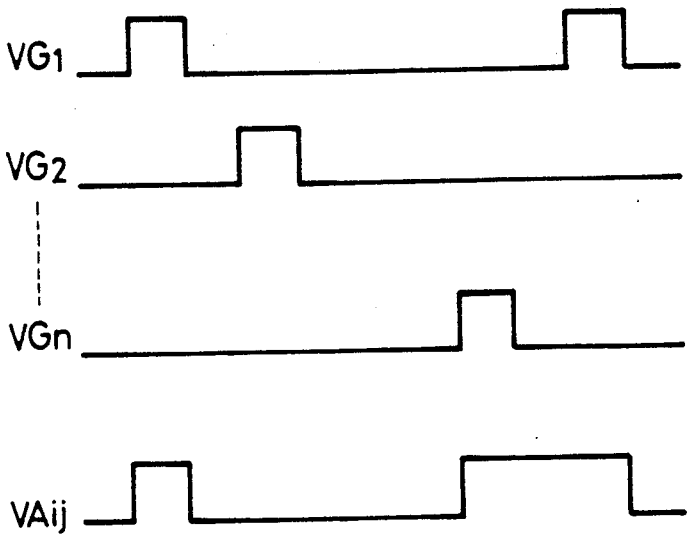
FIG. 5 PRIOR ART
FIG. 5 shows a time chart of examples of conventional grid drive voltages and a conventional anode drive voltage.
Figure 6:
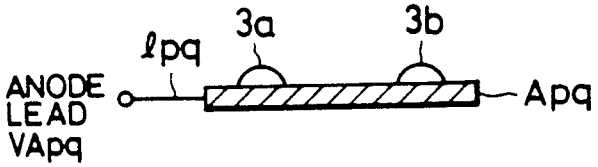
FIG. 6 shows an enlarged sectional view of an anode which is an embodiment of the present invention.
Figure 7:
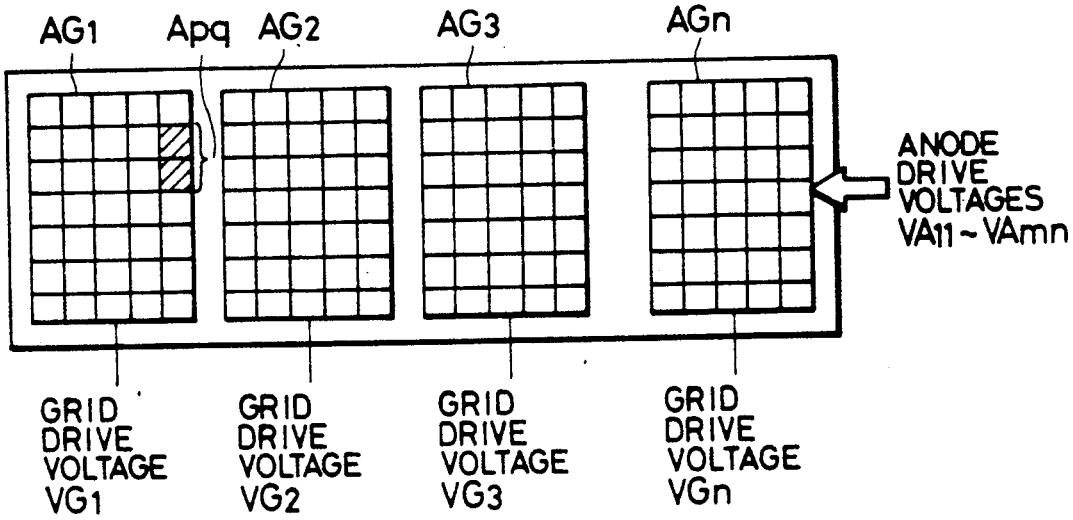
FIG. 7 shows a schematic view of a dot-matrix fluorescent display device provided according to the present invention.

According to the invention, FIG. 6 shows an enlarged sectional view of an anode $A_{pq}$ included in a dot-matrix fluorescent display device. Two light emitters 3*a* and 3*b* are provided on the surface of at least one anode $A_{pq}$ included in an anode group $AG_i$. An anode lead wire $1_{pq}$ is connected to the anode $A_{pq}$. When an anode drive voltage $VA_{pq}$ is applied to the anode $A_{pq}$ through the anode lead wire $1_{pq}$, the light emitters 3*a* and 3*b* both emit light. For that reason, the single anode $A_{pq}$ can function for two image elements. For example, a dot-matrix fluorescent display device includes such anodes $A_{pq}$ instead of conventional anodes $A_{25}$ and $A_{35}$ belonging to an anode group $AG_1$, as shown in FIG. 4. Such light emitters 3*a* and 3*b* simultaneously emit light, as shown by the hatching in FIG. 7, when a grid drive voltage $VG_1$ and an anode drive voltage $VA_{25}$ are simultaneously applied.

If a plurality of light emitters are provided on the surface of one anode, as described above, so as to reduce the number of all anodes, two grids for two adjacent anode groups can be decreased to one grid for the two adjacent anode groups. The number of all grids can thus be reduced as well.

If a dot-matrix fluorescent display device, in which the numbers of anodes and grids are reduced as described above, is driven and controlled through a microcomputer, a displayed image can be easily regulated. If the output terminals of the microcomputer are designed to resist a high voltage, the fluorescent display tube of the device can be directly driven so as to make the cost of the device low and its operation easy.

What is claimed is:

1. A dot-matrix display including a fluorescent display tube comprising:

a first number of image elements, wherein respective first and second groups of said image elements are provided for forming first and second images, said first and second groups have some image elements in common, and there is at least one light emitting element for each image element;

a filament;

a grid; and a second number of anodes, disposed on a side of said grid opposite said filament, for supporting said light emitting elements, wherein one of said anodes supports a plurality of said light emitting elements and all of said light emitting elements corresponding to at least two of said common image elements, said second number being less than said first number of image elements.

2. A dot matrix display as recited in claim 1, wherein some of said anodes have disposed thereon only one said light emitter.

3. A dot matrix display as recited in claim 1, wherein said array of anodes is arranged in a two dimensional pattern.

4. A dot matrix display as recited in claim 2, wherein said array of anodes is arranged in a two dimensional pattern.

5. A dot matrix display as recited in claim 4, further comprising separate anode lead wires connected to said anodes.

6. A dot-matrix display including a fluorescent display tube comprising:

a first number of image elements, wherein respective first and second groups of said image elements are provided for forming first and second images, said first and second groups have some image elements in common, and thee is at least one light emitting element for each image element;

a filament for emitting thermoelectrons;

means for generating a grid drive voltage;

a grid for accelerating and diffusing said thermoelectrons in response to said grid drive voltage;

means for generating an anode drive voltage; and a second number of anodes, disposed on a side of said grid opposite said filament, for supporting said light emitting elements, a single anode drive voltage lead wire being connected to each of said anodes, wherein one of said anodes supports a plurality of said light emitting elements and all of said light emitting elements corresponding to at least two of said common image elements for simultaneously causing said light emitting elements for said at least two of said common image elements to emit light in response to said anode drive voltage, said second number being less than said first number of image elements.

7. A dot-matrix display including a fluorescent display tube comprising:

a first number of image elements, wherein respective first and second groups of said image elements are provided for forming first and second images, said first and second groups have some image elements in common, and there is at least one light emitting element for each image element;

a filament;

a grid; and a second number of arrayed anodes, disposed on a side of said grid opposite said filament, for supporting said light emitting elements, wherein one of said anodes supports a plurality of said light emitting elements and all of said light emitting elements corresponding to at least two of said common image elements, said second number being less than said first number of image elements a number of light emitting elements being equal to the first number of image elements so that said second number of anodes is less than the first number.

* * * * *